US006019570A

United States Patent [19]

Talaski

[11] Patent Number: 6,019,570

[45] Date of Patent: Feb. 1, 2000

[54] PRESSURE BALANCED FUEL PUMP IMPELLER

[75] Inventor: Edward J. Talaski, Caro, Mich.

[73] Assignee: Walbro Corporation, Cass City, Mich.

[21] Appl. No.: 09/003,196

[22] Filed: Jan. 6, 1998

[51] Int. Cl.[7] ..... F01D 1/12

[52] U.S. Cl. ..... 415/55.1; 415/106; 417/365; 417/423.1

[58] Field of Search ..... 417/365, 423.1; 415/55.1, 55.2, 55.3, 55.4, 106

[56] References Cited

U.S. PATENT DOCUMENTS

| | | | |
|---|---|---|---|
| 4,451,213 | 5/1984 | Takei et al. | 417/366 |
| 4,462,761 | 7/1984 | Ringwald | 417/203 |
| 4,586,877 | 5/1986 | Watanabe et al. | 417/365 |
| 4,854,830 | 8/1989 | Kozawa et al. | 417/365 |
| 5,137,418 | 8/1992 | Sieghartner | 417/56.1 |
| 5,257,916 | 11/1993 | Tuckey | 417/423.3 |
| 5,607,283 | 3/1997 | Kato et al. | 415/55.1 |

FOREIGN PATENT DOCUMENTS

| | | |
|---|---|---|
| 9218042 | 6/1993 | Germany . |
| 4341563 | 6/1995 | Germany . |
| 19528181 | 2/1997 | Germany . |

*Primary Examiner*—Charles G. Freay

*Assistant Examiner*—Ehud Gartenberg

*Attorney, Agent, or Firm*—Reising, Ethington, Barnes, Kisselle, Learman & McCulloch, P.C.

[57] ABSTRACT

An electric motor turbine-type fuel pump has an impeller driven to rotate by the motor and received between opposed faces of a first body and a second body defining a pumping channel about the periphery of the impeller, each face has a plurality of circumferentially spaced and separate cavities disposed radially inwardly of the pumping channel and constructed to contain pressurized fuel adjacent the impeller to balance the axial forces across the impeller and center the impeller between the first body and second body. If desired, to ensure communication between a cavity and the pumping channel, a shallow groove or flow passage can be provided extending between the cavity and the pumping channel. The cavities in both the first body and second body are complementarily sized and arranged to provide a surface area adjacent the impeller and a pressure therein sufficient to balance the forces acting on each side of the impeller. With the impeller centered between the first body and the second body, a slight gap is provided between the impeller and each body and fuel leakage between the impeller and each body provides a fluid film or fluid bearing which reduces the resistance to rotation of the impeller. This reduces the wear of the impeller in use and the torque needed to rotate it and increases both the efficiency and the life of the fuel pump in use.

14 Claims, 3 Drawing Sheets

PRESSURE BALANCED FUEL PUMP IMPELLER

FIELD OF THE INVENTION

This invention relates to fuel pumps and more particularly to an electric motor turbine-type fuel pump.

BACKGROUND OF THE INVENTION

Electric motor turbine-type fuel pumps have been used in, for example, automotive fuel delivery systems. Pumps of this type typically include a housing adapted to be immersed in a fuel supply tank with an inlet for drawing fuel from the surrounding tank and an outlet for feeding fuel under pressure to the engine. A turbine impeller is coupled to a rotor driven to rotate by the electric motor and has an arcuate pumping channel surrounding its periphery for developing fuel pressure through rotation of the impeller. One example of a fuel pump of this type is illustrated in U.S. Pat. No. 5,257,916.

In fuel pumps of this type, the impeller is received between a pair of bodies disposed on each side of the impeller and in use, fuel leaks through the clearances between the impeller and the bodies. To reduce this leakage loss, the clearances between the impeller and the adjacent bodies are designed to be extremely small. Thus, especially if the dimensional accuracy of the impeller and the adjacent bodies is low, an unbalanced pressure acting on the impeller will generate an increased frictional resistance to rotation of the impeller between the bodies and as a result, increases the wear of the impeller in use and the operating torque required to rotate it thereby decreasing the efficiency and life of the pump.

One attempt to solve this problem is disclosed in U.S. Pat. No. 4,854,830 which provides for so-called pressure compensation hollows and/or grooves formed in the impeller. The hollows and/or grooves are constructed to communicate with fuel adjacent opposed faces of the impeller to balance the impeller between opposed surfaces in the fuel pump.

SUMMARY OF THE INVENTION

An electric motor turbine-type fuel pump has an impeller driven to rotate by the motor and received between opposed faces of a first body and a second body defining a pumping channel about the periphery of the impeller, each face has a plurality of circumferentially spaced and separate cavities disposed radially inwardly of the pumping channel and constructed to contain pressurized fuel adjacent the impeller to balance the axial forces across the impeller and center the impeller between the first body and second body. If desired, to ensure communication between a cavity and the pumping channel, a shallow groove or flow passage can be provided extending between the cavity and the pumping channel. The cavities in both the first body and second body are complementarily sized and arranged to provide a pressure therein, when filled with fuel in use, sufficient to balance the forces acting on each side of the impeller. With the impeller centered between the first body and the second body, a slight gap is provided between the impeller and each body and fuel leakage between the impeller and each body provides a fluid film or fluid bearing which reduces the resistance to rotation of the impeller. This reduces the wear of the impeller in use and the torque needed to rotate it and increases both the efficiency and the life of the fuel pump in use.

The opposed faces of the first body and the second body wherein the cavities are formed are preferably mirror images of each other such that each cavity in the first body has an axially opposed corresponding cavity in the second body in the same radial and circumferential location relative to the impeller and of the same size as the cavity in the first body. Further, for each cavity in the first body with a flow passage communicating it with the pumping channel, a complementarily shaped flow passage is provided in the second body communicating the corresponding cavity in the second body with the same circumferential location of the pumping channel as the flow passage in the first body. Communicating with the same location of the pumping channel provides fuel at the same pressure to corresponding cavities in the first and second body so that the fuel in each cavity in the first body is at substantially the same pressure as the fuel in its corresponding cavity in the second body to balance the forces acting on the impeller with respect to the first and second bodies. With the forces acting on the impeller substantially balanced and the impeller centered between the first and second bodies, movement of the impeller towards one of the bodies will increase the pressure between the impeller and that body and the higher pressure will move the impeller back towards its centered location between the first and second body. In this manner, the cavities act to maintain substantially even pressures acting on each side of the impeller to center the impeller between the first body and second body and inhibit it from engaging or bearing on either of the bodies.

Objects, features and advantages of this invention include providing a turbine-type fuel pump that balances the forces acting on each side of the impeller, reduces the frictional resistance to rotation of the impeller, reduces fuel leakage adjacent the impeller, reduces wear on the impeller, reduces the torque necessary to rotate the impeller, increases the efficiency of the fuel pump, increases the life of the fuel pump in use, is of relatively simple design and economical manufacture and in service has a long useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFFERED EMBODIMENTS

Figure 1:
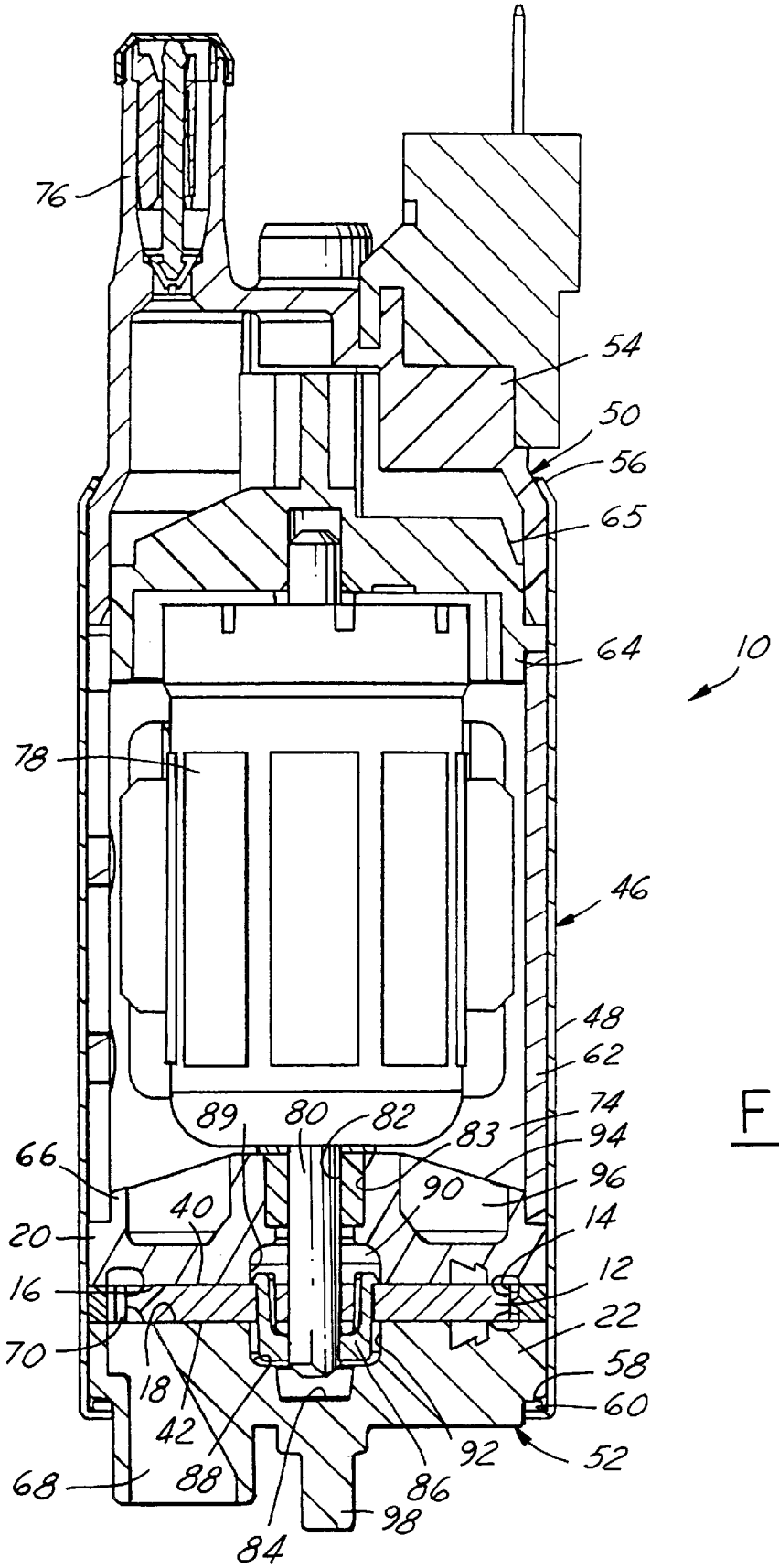
FIG. 1 is a sectional view of a turbine-type fuel pump embodying this invention.

Referring in more detail to the drawings, FIGS. 1–5 show an electric motor turbine-type fuel pump 10 with an impeller 12 defining in part a pumping channel 14 about its periphery and received between opposed and generally flat faces 16, 18 of a first body 20 and a second body 22, respectively. Each face 16, 18 has a plurality of circumferentially spaced and separate cavities 24–38 formed therein radially inwardly of the pumping channel 14 and constructed to contain pressurized fuel in communication with an adjacent face 40 or 42 of the impeller 12 to balance the forces acting on the impeller 12 and center it between the first body 20 and second body 22. Optionally, the cavities 24–38 can be independently and directly communicated with the pumping channel 14 through a shallow groove defining a flow passage 44 between the pumping channel 14 and cavity 24–38. Forming the cavities 24–38 in the first body 20 and second body 22 reduces the surface area of each which is immediately adjacent the impeller 12 and thereby reduces their frictional engagement with the impeller 12. Centering the impeller 12 between the bodies provides a gap or clearance adjacent each face 40, 42 of the impeller 12 each of which substantially fills with fluid in use providing a fluid bearing adjacent each face 40, 42 of the impeller 12 that reduces the frictional engagement of the impeller 12 with the first body 20 and second body 22. This decreases the torque necessary to rotate the impeller 12 and increases the efficiency and life of the fuel pump 10 in use.

A fuel pump housing 46 is formed of a tubular outer shell 48 with a pair of open ends 50, 52 one of which receives an outlet body 54 abutting an inwardly extending rim 56 to retain the outlet body 54 and the other end receives and is rolled around a circular shoulder 58 of the second body 22 with a sealing member 60 received between them to prevent leakage therethrough. A stator 62 of the motor is received within the outer shell 48 and telescopically receives an annular flange 64, a brush housing 65 and an annular flange 66 of the first body 20. The fuel pump 10 has an inlet passage 68 (shown out of normal position) in the second body 22 through which fuel is drawn into an inlet port 70 of the pumping channel 14 to admit fuel into the pumping channel 14. An outlet port 72 of the pumping channel 14 is open through the body 20 to the interior 74 of the housing 46 which has an outlet passage 76 in the outlet body 54 through which fuel is delivered under pressure.

A rotor 78 is journalled for rotation within the housing 46 by a shaft 80 extending through a bushing 82 in a counterbore 83 of the first body 20, received within a blind bore 84 of the second body 22, and coupled with the impeller 12 by a clip 86 to drive the impeller 12 for co-rotation with the shaft 80. The blind bore 84 preferably has a counterbore 88 providing radial clearance for rotation of the clip 86 coupling the rotor 78 and impeller 12. The counterbore 89 in the first body 20 and the counterbore 88 in the second body 22 are generally coaxial and define a first recess 90 and a second recess 92 adjacent the upper face 40 and a lower face 42 of the impeller 12, respectively.

The impeller 12 is preferably of a one piece plastic or ceramic construction, having the geometry of a flat disk of generally uniform thickness with its flat upper face 40 and flat lower face 42 generally parallel to each other and axially opposed. The upper face 40 of the impeller 12 is received adjacent the generally flat face 16 of the first body 20 and the lower face 42 of the impeller 12 is received adjacent the generally flat face 18 of the second body 22. Typically, the clearance between the impeller 12 and the first body 20 and the impeller 12 and the second body 22 totals about 0.0015 inch.

The first body 20 has a plurality of support ribs 94 extending from adjacent the counterbore 83 to the annular flange 66 and defining pockets 96 therebetween. The cavities 24–30 are formed in the generally circular flat face 16 of the first body 20 radially inwardly from the pumping channel 14, circumferentially spaced from each other and of various sizes corresponding to their circumferential location with respect to the pumping channel inlet 70 and outlet 72. As shown, four cavities 24, 26, 28, 30 are formed in the first body 20 with a first cavity 24 nearest the inlet port 70 of the pumping channel 14, a second cavity 26 downstream of the first cavity 24, a third cavity 28 downstream of the second cavity 26 and a fourth cavity 30 downstream of the third cavity 28 and generally adjacent the outlet port 72 of the pumping channel 14. The second 26, third 28 and fourth 30 cavities are preferably directly in communication with the pumping channel 14 through independent flow passages 44.

The second body 22 has a generally cylindrical stem 98 extending therefrom and constructed to be received in an opening of the fuel filter for the retention thereof by means of a clip. The flat face 18 of the second body 22 is preferably substantially a mirror image of the opposed face 16 of the first body 20. The second body 22 has a first cavity 32 adjacent the inlet port 70 of the pumping channel 14, a second cavity 34 downstream of the first cavity 32, a third cavity 36 downstream of the second cavity 34 and a fourth cavity 38 downstream of the third cavity 36 and generally adjacent the outlet port 72 of the pumping channel 14. Each cavity 32, 34, 36, 38 in the second body 22 is complementarily formed in size, shape, and location relative to the impeller 12 and the pumping channel 14, as a corresponding cavity 24, 26, 28, 30, respectively, in the first body 20. Independent flow passages 44 preferably communicate the second 34, third 36 and fourth 38 cavities of the second body 22 with the pumping channel 14 at the same circumferential location as the corresponding cavities 26, 28, 30 in the first body 20.

For a fuel pump 10 having a nominal 60 psi output, the inlet 70 of the pumping channel 14 will be at a reduced pressure, nominally 0 psi. The outlet 72 of the pumping channel 14 will be at or slightly above the output pressure of the fuel pump of 60 psi. At a point in the pumping channel 14 circumferentially essentially equidistant from its inlet 70 and outlet 72 the fuel pressure will be approximately one-half the difference between the outlet 72 and inlet 70 pressure, or 30 psi. This is substantially equal to the pressure generally radially inwardly of the pumping channel 14 and within the first 90 and second 92 recesses defined by the first body 20 and second body 22 respectively.

Throughout the fuel pump 10, fuel flow is dictated by pressure differentials with the fuel flowing from areas of higher pressure to areas of lower pressure. In use, fuel leaks between the impeller 12 and both the first body 20 and second body 22 due to the pressure differentials across the impeller 12. Thus, the fuel within the recesses 90, 92 defined by the first 20 and second 22 bodies, tends to flow or leak towards the inlet 70 of the pumping channel 14 which is at a lower pressure then that within the recesses 90, 92. Conversely, the outlet 72 of the pumping channel 14 is at a pressure higher than that within the recesses 90, 92 and thus, the fuel adjacent the outlet 72 of the pumping channel 14 tends to leak towards the recesses 90, 92. At a point in the pumping channel 14 equidistant from its inlet 70 and outlet 72, there is minimal fuel exchange between the recesses 90, 92 and the pumping channel 14 because they are at substantially equal pressures.

Forming the cavities 24–38 in the bodies 20, 22 reduces the surface area of the flat faces 16, 18 of each body 20, 22 which are adjacent the impeller 12, and define the radial and circumferentially extent of the minimum clearance areas between the impeller 12 and the bodies 20, 22, which resist the fuel leakage therethrough. Thus, by reducing surface area, the cavities 24–38 themselves tend to increase the fuel leakage between the impeller 12 and the bodies 20, 22. Because of this it is desirable to minimize the size of the cavities 24–38 which are formed where the leakage rate between the impeller 12 and the bodies 20, 22 is greatest, namely the first 24, 32 and fourth 30, 38 cavities which are adjacent the inlet 70 and the outlet 72 of the pumping channel 14, respectively, wherein the pressure differential between the pumping channel 14 and the recesses 90, 92 is greatest. The second 26, 34 and third 28, 36 cavities of each body 20, 22 respectively, can be made larger due to their location generally adjacent the mid-point of the pumping channel 14 because of the minimal fuel leakage therethrough and thus the reduced need for the opposed flat surface areas between the bodies 20, 22 and the impeller 12.

Additionally, because it is desirable to maintain as much of the surface areas of the flat faces 16, 18 of the first body 20 and second body 22 that are adjacent the inlet port 70 and outlet port 72 of the pumping channel 14, in the locations with the greatest pressure differential, the first cavities 24, 32 are radially spaced farther from the recesses 90, 92 to provide increased resistance to fuel leakage from the higher pressure recesses 90, 92 towards the inlet port 70 of the pumping channel 14 which is at a relatively low pressure. Similarly, the fourth cavities 30, 38 are radially spaced farther from recesses 90, 92 and closer to the pumping channel 14 to resist fuel leakage from the cavities 30, 38 towards the recesses 90, 92 which are at a lower pressure than these cavities and the adjacent portion of the pumping channel 14.

To better control the pressure within the cavities 24–38 and acting on the impeller 12, the flow passages 44 can be provided to communicate the desired cavities 24–38 with the pumping channel 14. Preferably, the flow passages 44 communicate with the pumping channel 14 generally adjacent the furthest downstream portion of the corresponding cavity 24–38 to raise the pressure within the cavity 24–38 generally to the pressure of that location in the pumping channel 14. This raises the pressure within the cavity 24–38 which, without a flow passage 44, would be at a pressure which is a function of the average pressure over the circumferentially adjacent portion of the pumping channel 14. The increased pressure in the cavity 24–38 and acting on the impeller 12 improves the balancing of the impeller 12 by increasing the resistance to axial movement of the impeller 12. Due to the symmetry between the cavities of first body 20 and second body 22, the corresponding cavity of the other body 20, 22 will be at the same pressure and will provide an equal but opposite resistance to axial movement of the impeller 12 thereby centering the impeller 12 between the first body 20 and second body 22.

Figure 2:
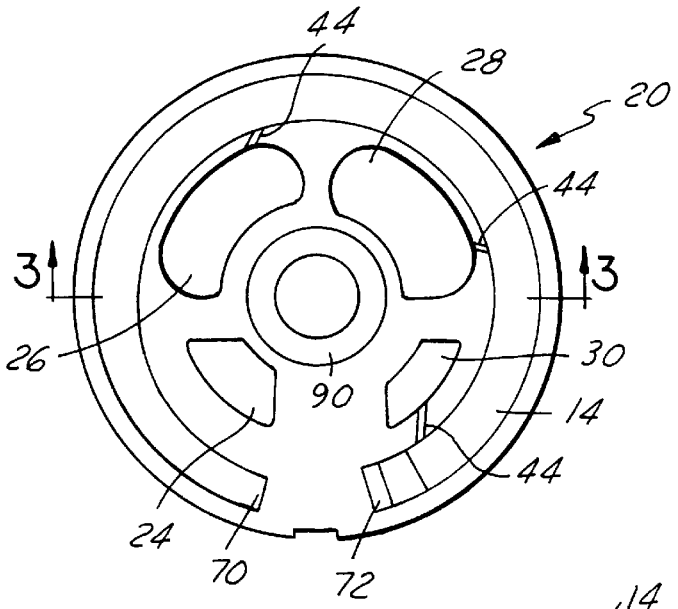
FIG. 2 is a bottom view of the first body of the fuel pump illustrating the cavities formed therein.
Figure 3:
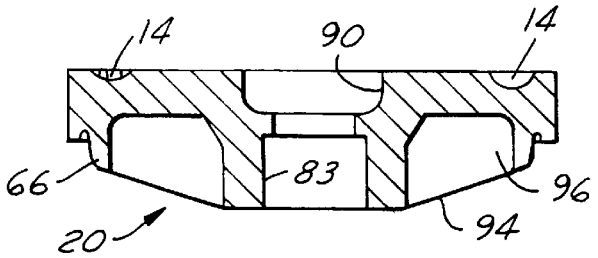
FIG. 3 is a sectional view taken along line 3—3 of FIG. 2.
Figure 4:
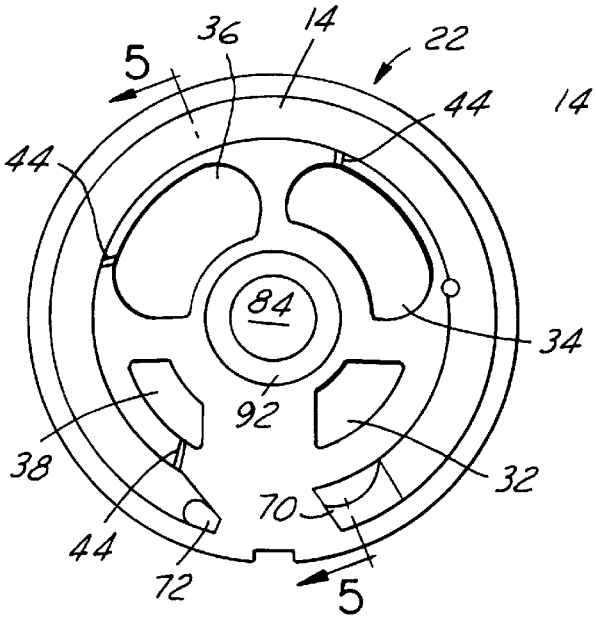
FIG. 4 is a top view of the second body of the fuel pump illustrating the cavities formed therein.
Figure 5:
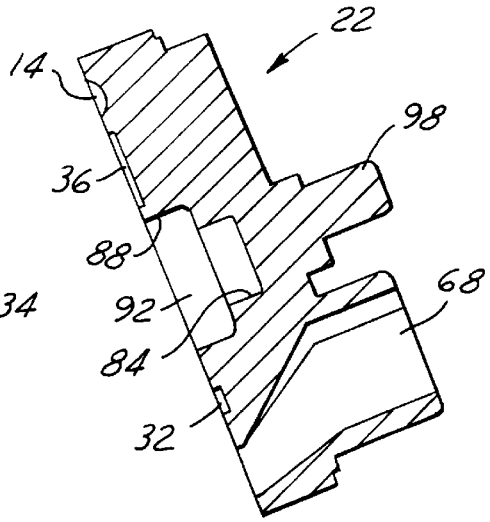
FIG. 5 is a sectional view taken along line 5—5 of FIG. 4.

As shown in FIGS. 2 and 4, the first cavity 24, 32 in each body 20, 22 is not directly communicated with the pumping channel 14 by a flow passage 44. Empirical and theoretical analysis has shown that the first cavities 24, 32 tend to be at a higher pressure than any adjacent portion of the pumping channel 14. Thus, providing a flow passage 44 communicating the first cavities 24, 32 with the adjacent portion of the pumping channel 14 would lower the pressure in the first cavities 24, 32 and thereby decrease the resistance to axial movement of the impeller 12 towards the first body 20 and second body 22.

Figure 6:
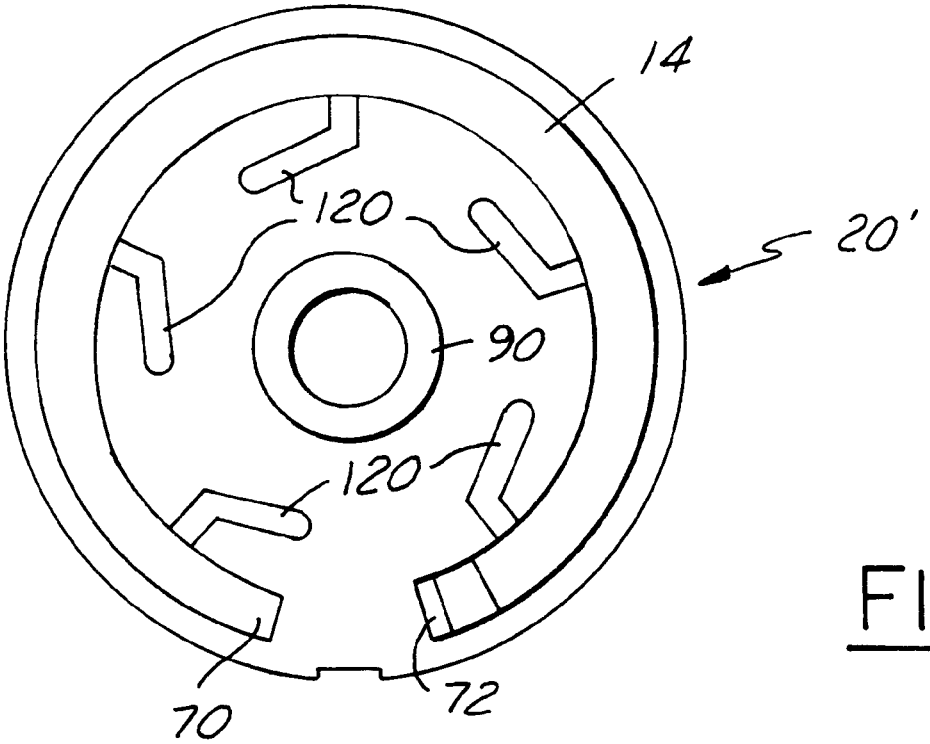
FIG. 6 is a bottom view of a first body of an alternate embodiment of this invention.
Figure 7:
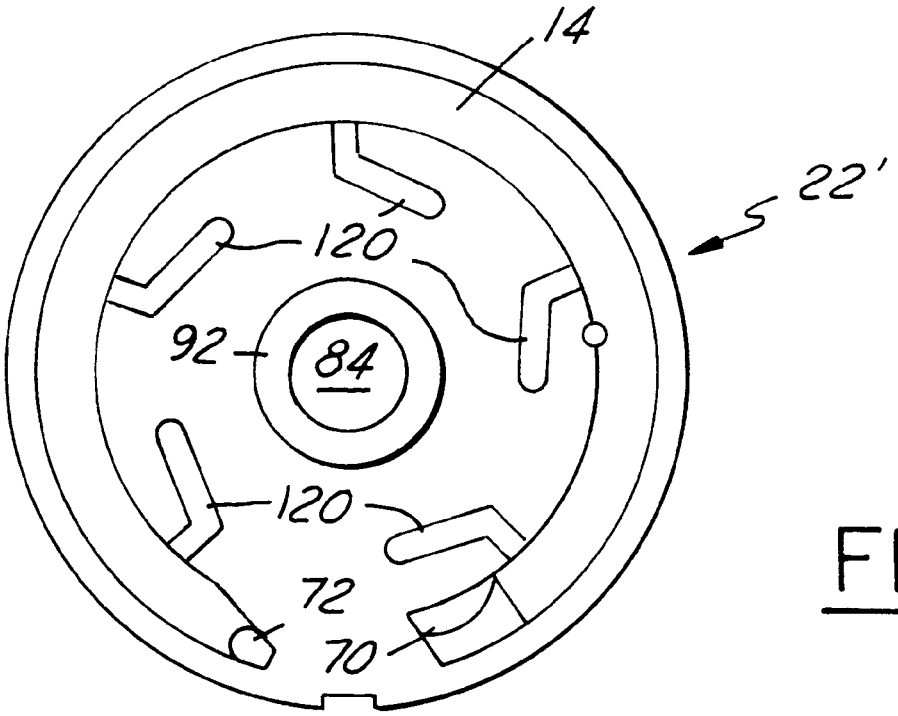
FIG. 7 is a top view of a second body of the embodiment in FIG. 6.

An alternate embodiment of the first body 20' and second body 22' of the pump 10 are shown in FIGS. 6 and 7, respectively. In this embodiment, a plurality of channels 120 are formed extending radially inwardly from the pumping channel 14 and preferably inclined or canted in the generally upstream direction. Because the pressure in the pumping channel 14 decreases in the upstream direction, communicating the channels 120 with the pumping channel 14 at a downstream location increases the pressure in the channels 120 which is communicated with an adjacent 40, 42 face of the impeller 12. As in the preferred embodiment, the first body 20' and second body 22' are mirror images of each other with complementarily formed channels 120 each constructed to contain pressurized fuel at the same pressure as its corresponding channel 120 in the other body 20', 22'. Thus, the channels 120 provide generally equal and opposite forces acting on the impeller 12 to balance and center it between the first body 20' and the second body 22'.

The first body 20, 20' and second body 22, 22' are preferably mirror images of each other providing cavities 24–38 or channels 120 adjacent each side of the impeller 12 which are of the same size, at the same location relative to the impeller 12 and the pumping channel 14, and in communication with the pumping channel 14 at the same location if so communicated and thus, in use contain fuel at the same pressure. This provides forces within the cavities 24–38 or channels 120 which, although varied from cavity to cavity or channel to channel in the same body, are equal with respect to the corresponding cavities or channels in the other body to balance the forces on the opposed faces 40, 42 of the impeller 12. This centers the impeller 12 between the first body 20, 20' and second body 22, 22' and provides a fluid bearing between the impeller 12 and each body thereby reducing the frictional engagement between them, the wear on the impeller 12 and the torque needed to rotate the impeller 12 and increases the efficiency and life of the fuel pump 10 in use.

I claim:

1. A fuel pump comprising:

a housing;

a motor received within the housing;

an impeller driven to rotate by the motor, having a pair of opposed faces and defining in part a pumping channel about its periphery;

a first body carried by the housing adjacent one face of the impeller and having a plurality of circumferentially spaced and separate cavities formed in the first body radially inwardly of the pumping channel and in communication with the impeller;

a second body carried by the housing adjacent the other face of the impeller and having a plurality of circumferentially spaced and separate cavities formed in the second body radially inwardly of the pumping channel and in communication with the impeller, the opposed faces of the first body and the second body each having said cavities of substantially the same size and location relative to the impeller, separate flow passages individually communicating each of at least two of the cavities of both the first and second body with he pumping channel, and wherein the cavities of the first body and the second body are constructed to balance the forces acting on the impeller when filed with fuel during use of the fuel pump to generally center the impeller between the first body and the second body.

2. The fuel pump of claim 1 wherein the first body and second body each have a generally flat face adjacent the impeller and generally opposed to each other and the axial dimension between the opposed faces of the first body and second body is slightly greater than the axial dimension between the opposed faces of the impeller.

3. The fuel pump of claim 1 wherein the pumping channel is substantially circumferentially continuous about the periphery of the impeller and has an inlet end into which fuel is drawn and an outlet end through which fuel is delivered under pressure.

4. The fuel pump of claim 2 wherein the opposed faces of the first body and second body are substantially mirror images of each other, each having cavities of the same size, shape and location relative to the impeller.

5. The fuel pump of claim 1 wherein the first body and second body each have a first cavity generally adjacent the inlet of the pumping channel, a second cavity downstream of the first cavity, a third cavity downstream of the second cavity and a fourth cavity downstream of the third cavity and generally adjacent the outlet of the pumping channel.

6. The fuel pump of claim 5 also comprising separate flow passages individually communicating the second, third and fourth cavities of both the first body and second body with the pumping channel.

7. The fuel pump of claim 6 wherein each flow passage of the second body communicates with the same circumferential location of the pumping channel as its corresponding flow passage in the first body.

8. The fuel pump of claim 6 wherein each flow passage communicates with the pumping channel generally adjacent the furthest downstream portion of its corresponding cavity.

9. The fuel pump of claim 1 wherein the first body and second body define in part first and second recesses, respectively, centrally located in each body and each in communication with an adjacent face of the impeller.

10. The fuel pump of claim 6 wherein the flow passages are grooves formed in the opposed faces of the first body and second body.

11. The fuel pump of claim 1 wherein the cavities in the first body and the second body are generally narrow channels communicating with the pumping channel at one end and extending generally radially inwardly therefrom.

12. The fuel pump of claim 11 wherein the end of each channel communicating with the pumping channel is circumferentially spaced and generally downstream of the other end of the channel.

13. The fuel pump of claim 11 wherein the opposed faces of the first body and second body are substantially mirror images of each other.

14. The fuel pump of claim 13 wherein each channel in the first body communicates with the pumping channel at the same circumferential location as its corresponding channel in the second body.

* * * * *

UNITED STATES PATENT AND TRADEMARK OFFICE

CERTIFICATE OF CORRECTION

PATENT NO. : 6,019,570

DATED : February 1, 2000

INVENTOR(S) : Edward J. Talaski

It is certified that error appears in the above-indentified patent and that said Letters Patent is hereby corrected as shown below:

Col 6, Line 54, delete "he" and insert -- the --.

Col 6, Line 57, delete "filed" and insert -- filled --.

Signed and Sealed this

Third Day of April, 2001

Nicholas P. Godici

*Attest:*

NICHOLAS P. GODICI

*Attesting Officer*

*Acting Director of the United States Patent and Trademark Office*